US007094049B2

(12) United States Patent
Mizuno et al.

(10) Patent No.: US 7,094,049 B2
(45) Date of Patent: Aug. 22, 2006

(54) QUARTZ GLASS SINGLE HOLE NOZZLE FOR FEEDING FLUID AND QUARTZ GLASS MULTI-HOLE BURNER HEAD FOR FEEDING FLUID

(75) Inventors: Toru Mizuno, Fukushima (JP); Hirokazu Mizuno, Fukushima (JP); Ichiro Yanase, Takefu (JP); Hyung-Bae Kim, Tokyo (JP)

(73) Assignees: Atock Co., Ltd., Ibaraki (JP); Shin-Etsu Quartz Products Co., Ltd., Tokyo (JP)

( * ) Notice: Subject to any disclaimer, the term of this patent is extended or adjusted under 35 U.S.C. 154(b) by 0 days.

(21) Appl. No.: 10/495,806

(22) PCT Filed: Dec. 3, 2002

(86) PCT No.: PCT/JP02/12633

§ 371 (c)(1),
(2), (4) Date: May 17, 2004

(87) PCT Pub. No.: WO03/048641

PCT Pub. Date: Jun. 12, 2003

(65) Prior Publication Data

US 2005/0003317 A1 Jan. 6, 2005

(30) Foreign Application Priority Data

Dec. 4, 2001 (JP) ..... 2001-370748

(51) Int. Cl.
*F23D 14/48* (2006.01)
*F23D 14/58* (2006.01)

(52) U.S. Cl. ..... 431/350; 431/8; 431/326

(58) Field of Classification Search ..... 431/8, 431/10, 159, 181, 326, 328, 350
See application file for complete search history.

(56) References Cited

U.S. PATENT DOCUMENTS 1,044,651 A * 11/1912 Harris ..... 239/429

(Continued)

FOREIGN PATENT DOCUMENTS

DE DT 23 50 040 * 4/1975

(Continued)

OTHER PUBLICATIONS

International Search Report for PCT/JP02/12633 mailed on Apr. 1, 2003.

*Primary Examiner*—Carl D. Price
(74) *Attorney, Agent, or Firm*—Rader, Fishman & Grauer

(57) ABSTRACT

The present invention provides a quartz glass single hole nozzle for feeding fluid capable of performing high-precision control of a flow rate, a burner for heat processing equipped with the quartz glass single hole nozzle, a quartz glass multihole burner head for feeding fluid preferably used in flame processing or the like, and a quartz glass burner for heat processing equipped with the multihole burner. By using the nozzle, even if a distal end portion of the quartz glass burner, namely the nozzle is broken by contact with a workpiece or the like, it is enough to only replace the broken nozzle with a new one without a necessity for replacing the entire expensive quartz glass burner. When applying the nozzle to a metal burner, there can be given usefulness of the quartz glass such as heat resistance and contamination resistance or the like. The quartz glass single hole nozzle for feeding fluid according to the present invention comprises: a nozzle body portion made of a quartz glass material; and an attaching portion provided at the proximal end of the nozzle body portion, wherein a fluid feed path is bored in the interior of the nozzle body portion and the attaching portion of the nozzle body portion is detachably attachable to the distal end of a burner body for heat processing.

2 Claims, 5 Drawing Sheets

U.S. PATENT DOCUMENTS

| | | | | | |
|---|---|---|---|---|---|
| 1,453,385 | A | * | 5/1923 | Dzutsoff | 239/586 |
| 1,590,882 | A | * | 6/1926 | Brown et al. | 239/430 |
| 1,666,387 | A | * | 4/1928 | Jones | 239/589 |
| 1,867,526 | A | * | 7/1932 | Anderson et al. | 239/600 |
| 1,940,171 | A | * | 12/1933 | Huss | 239/493 |
| 2,009,932 | A | * | 7/1935 | Klotzman | 239/493 |
| 2,071,165 | A | * | 2/1937 | Harper et al. | 475/139 |
| 2,151,443 | A | * | 3/1939 | Ruch | 239/562 |
| 2,207,655 | A | * | 7/1940 | Cain | 239/290 |
| 2,343,958 | A | * | 3/1944 | Crowe | 239/549 |
| 2,348,385 | A | * | 5/1944 | Houghton | 239/530 |
| 2,512,705 | A | * | 6/1950 | Anderson et al. | 219/75 |
| 2,512,706 | A | * | 6/1950 | Anderson | 219/75 |
| 2,714,833 | A | * | 8/1955 | Gilbert, Jr. | 431/126 |
| 2,727,126 | A | * | 12/1955 | Guest et al. | 219/75 |
| 3,209,811 | A | * | 10/1965 | Strang | 431/90 |
| 3,213,523 | A | * | 10/1965 | Boehler | 29/890.11 |
| 3,356,830 | A | * | 12/1967 | Schleer et al. | 392/476 |
| 3,823,408 | A | * | 7/1974 | Gordon, III | 347/47 |
| 3,921,916 | A | * | 11/1975 | Bassous | 239/601 |
| 4,202,660 | A | * | 5/1980 | Pei | 431/328 |
| 4,261,518 | A | * | 4/1981 | Russell | 239/424.5 |
| 4,368,063 | A | * | 1/1983 | Presby | 65/42 |
| 4,966,875 | A | * | 10/1990 | Micheli et al. | 501/152 |
| 5,112,219 | A | * | 5/1992 | Hiemstra | 431/354 |
| 5,186,621 | A | * | 2/1993 | Pennington | 431/354 |
| 5,447,427 | A | * | 9/1995 | Suzuki | 431/7 |
| 5,620,142 | A | * | 4/1997 | Elkas | 239/518 |
| 5,791,563 | A | * | 8/1998 | Marchionda et al. | 239/424.5 |
| 5,839,890 | A | * | 11/1998 | Snyder | 431/8 |
| 5,893,520 | A | * | 4/1999 | Elkas | 239/499 |

FOREIGN PATENT DOCUMENTS

| | | | | |
|---|---|---|---|---|
| DE | 41 37 297 | | * | 11/1991 |
| DE | 004137297 | A1 | * | 5/1993 |
| DE | 197 28 212 | | * | 9/1998 |
| EP | 000725252 | A1 | * | 8/1996 |
| JP | 54-034362 | U1 | | 3/1979 |
| JP | 54-126592 | | * | 10/1979 |
| JP | 58-99133 | | * | 6/1983 |
| JP | 60-228812 | | * | 11/1985 |
| JP | 61-83816 | | * | 4/1986 |
| JP | 63-070010 | A1 | | 3/1988 |
| JP | 63-115041 | U1 | | 7/1988 |
| JP | 64-14510 | | * | 1/1989 |
| JP | 64-014510 | A1 | | 1/1989 |
| JP | 64-28239 | | * | 1/1989 |
| JP | 01-169925 | U1 | | 11/1989 |
| JP | 02-38336 | | * | 2/1990 |
| JP | 02-038336 | A1 | | 2/1990 |
| JP | 03-196857 | | * | 8/1991 |
| JP | 04-45305 | | * | 2/1992 |
| JP | 05-215313 | | * | 8/1993 |
| JP | 07-277751 | | * | 4/1994 |
| JP | 07-321101 | | * | 12/1995 |
| JP | 08-26758 | | * | 1/1996 |
| JP | 08-68515 | | * | 3/1996 |
| JP | 11-237044 | | * | 8/1999 |
| JP | 2000-104908 | A1 | | 4/2000 |
| JP | 2000-104909 | | * | 4/2000 |

* cited by examiner (a)

(b)

QUARTZ GLASS SINGLE HOLE NOZZLE FOR FEEDING FLUID AND QUARTZ GLASS MULTI-HOLE BURNER HEAD FOR FEEDING FLUID

TECHNICAL FIELD

The present invention relates to a novel quartz glass single hole nozzle for feeding fluid, in which a fluid feeding path is bored, and capable of feeding fluid such as gas, liquid, powder and the like quantitatively, a quartz glass burner for heat processing equipped with the single hole nozzle, a quartz glass multihole burner head for feeding fluid, and a quartz glass burner for heat processing equipped with the multihole burner head.

BACKGROUND ART

Conventionally, in order to ensure durability against a high temperature generated in company with combustion, or durability against contamination and degradation in company with a chemical reaction such as a vapor phase reaction at a distal end and in a flow path, a burner made of quartz glass as a material has been known especially as a combustion burner for heat processing. In order to form a flow path in a quartz glass burner, however, a skilled artisan had to manually fabricate the burner from a quartz glass tube as starting materials taking a long time. Especially, a quartz glass burner with many flow paths has been fabricated using many quartz glass tubes as starting materials by a skilled artisan in such a way that the quartz glass tubes are deliberately processed one by one and thereafter the quartz glass tubes are accurately bundled into a single body to thereby complete the quartz glass burner.

However, since such a quartz glass burner is manually fabricated, there have inevitably arisen variations in dimensional precision between product lots and therefore a necessity has occurred for various settings or adjustments for heat processing in each lot of the burners by a scent of an operator manipulating a burner.

Therefore, as disclosed in, for example, JP A 2000-104908, a method has been proposed in which a burner head is mechanically and integrally machined from a quartz glass rod according to a boring method using a drill.

The inventors have continuously investigated and developed uses of the fabrication method, and have repeated serious studies on application thereof to a single hole burner nozzle and a multihole burner of a straight type which were mainly fabricated from metals such as stainless steel, iron, brass or copper in the prior art. As a result, the present invention has been achieved.

That is, conventionally, a metal single hole burner especially used for local heat processing lacks problematically agile operability because it is heavy for an operator, and more than anything else, when heat processing is continued for long time, since a distal end of the metal burner is overheated by reflecting heat from a workpiece, a phenomenon unavoidably occurs that spray of the metal or metal ions from the distal end may be stuck or migrated to the workpiece.

Even in case of no heat processing, when liquids high in corrosiveness and reactivity, for example, strong acids such as hydrochloric acid or strong bases such as caustic soda, or gases high in reactivity such as silicon tetrachloride are fed to the nozzle, an inconvenience inevitably occurs that the metal itself is corroded.

In view of the above, while a quartz glass single hole burner has been employed in a specified field, the burner is not of a type fabricated by directly drilling a high purity synthetic quartz glass rod with a boring diameter precisely set in such a way as disclosed in the present invention; therefore, flow control thereof cannot be necessarily performed with a high precision, and it requires various kinds of adjustment operations based on a scent of an operator manipulating the burner. Especially, in recent years, the heat processing utilizing a robot has been tried. In this case, if the heat processing is operated placing the burner at a fixed position and setting the other operating conditions, there are severely demanded uniformity in performance and reproducibility of a product of the burner itself, with which a complete measure for coping has been requested.

Moreover, when the distal end of the burner is broken by contact with a workpiece, an expensive quartz glass burner has to be totally replaced with a new one; measures to solve the problem have been awaited in various aspects. In a micro-processing field, for example, when a syringe drug glass ampoule for medical use is heat sealed, since a nozzle diameter is especially small, slight dimensional errors result in a difference in a feed rate of fluid; a quantitatively exact specification has been required. A precise specification has been similarly required in an ordinary micro-welding field as well.

Since JP A 2000-104908 described above discloses such a construction as convergence of a gas flow is indispensable, it has been also demanded to fabricate a multihole burner of non-convergence (in which feed paths are parallel to each other) which is employed, for example, in flame processing. However, since it has been difficult to fabricate the multihole burner maintaining an exact straight advance of drilling for boring, a problem has remained that fabrication of the multihole burner involves difficulty.

The inventors have continuously investigated and developed uses of the fabrication method, and found it to apply the method to a single hole burner head and a multihole burner of straight type which were mainly fabricated from metals such as stainless steel or copper in the prior art. As a result, the present invention has been achieved.

DISCLOSURE OF THE INVENTION

It is an object of the present invention to provide a quartz glass single hole nozzle for feeding fluid capable of performing high-precision control of a flow rate. By using the nozzle, even if a distal end portion of the quartz glass burner, namely the nozzle is broken by contact with a workpiece or the like, it is enough to only replace the broken nozzle with a new one without a necessity for replacing the entire expensive quartz glass burner. When applying the nozzle to a metal burner, there can be given usefulness of the quartz glass such as heat resistance and contamination resistance or the like. It is another object of the present invention to provide a burner for heat processing equipped with the quartz glass single hole nozzle. It is still another object to provide a quartz glass multihole burner head for feeding fluid preferably used in flame processing or the like, and a quartz glass burner for heat processing equipped with the multihole burner.

A quartz glass single hole nozzle for feeding fluid according to the present invention comprises: a nozzle body portion made of a quartz glass material; and an attaching portion provided at the proximal end of the nozzle body portion, wherein a fluid feed path is bored in the interior of the nozzle body portion and the attaching portion of the nozzle body portion is detachably attachable to the distal end of a burner body for heat processing.

Furthermore, when the machined quartz glass has machining strain and the strain needs removing, the strain of the entire nozzle may be removed by annealing. From the viewpoint of possible contamination of impurities, it is preferable to use synthetic quartz glass as the quartz glass material. The end portion of the quartz glass single hole nozzle for feeding fluid described above is detachably attachable to the distal end of the burner body for heat processing and hence when the nozzle alone is broken or contaminated, it is advantageous to easily replace the broken or contaminated nozzle with a new one. Note that if the attaching portion at the distal end of the single hole nozzle is provided with an external thread or an internal thread, the attaching and detaching operation is easy.

A quartz glass burner for heat processing according to the present invention comprises: a burner body portion; a burner head portion provided at the distal end of the burner body portion, wherein the quartz glass single hole nozzle for feeding fluid according to the present invention is attached to the burner head portion.

A metal or ceramic burner for heat processing according to the present invention comprises: a burner body portion; and a burner head portion provided at the distal end of the burner body portion, wherein the quartz glass single hole nozzle for feeding fluid according to the present invention is attached to the burner head portion.

A quartz glass burner for heat processing according to the present invention comprises: a burner body portion; a burner head portion provided at the distal end of the burner body portion; and a single hole nozzle having a nozzle body portion in the interior of which a fluid feed path is bored, wherein the single hole nozzle is integrally formed at the distal end of the burner head portion. In the above burner for heat processing, the burner head portion may be bent if necessary. A hand burner according to the present invention is a quartz glass burner for heat processing, a metal or ceramic burner for heat processing, or a burner for heat processing according to the present invention, which an operator can operate by hand. In the case where the entire burner body is made of quartz glass, it weighs about ⅕ of a stainless steel burner, and due to the light weight of the entire body precise operability is secured.

According to the hand burner of the present invention, in order to prevent a long stem portion from breakage, the burner body portion may be covered with a film of silicon rubber or any of other synthetic resins with shrinkability and flexibility when necessary.

A quartz glass multihole burner head for feeding fluid according to the present invention is fabricated by boring a quartz glass material. The multihole burner head is preferably constructed such that the fluid flows out in a state of non-convergence. To be concrete, the quartz glass multihole burner head for feeding fluid according to the present invention comprises: an outer cylinder; an inner cylinder provided in the interior of the outer cylinder at a prescribed space therebetween and having a fluid feed path in the interior thereof; a central cylinder provided in the interior of the inner cylinder at a prescribed space therebetween and having a fluid feed path in the interior thereof; a nozzle portion having many throughholes bored therein and integrally provided at the distal ends of the inner cylinder and the central cylinder; and a tip portion having many fluid path outlets bored therein and provided at the distal end of the outer cylinder located at a prescribed space in front of the distal end of the nozzle portion, wherein the fluid feed paths, the through holes and the fluid path outlets are parallel to each other, when discharging fluid a flow of the fluid is not converged, and the fluid flows out in a state of non-convergence.

A quartz glass burner for heat processing according to the present invention includes: a burner body portion; and a burner head portion provided at the distal end of the burner body portion, wherein the multihole burner head according to the present invention is used as the burner head portion.

That is, in the single hole burner used especially for local heat processing, by precisely drilling the central portion of a circular end surface of a quartz rod to bore a flow path having a prescribed diameter concentrically, with the result that flow rate control of a fluid fed through the flow path can be correctly performed. Furthermore, by providing an external thread or an internal thread at the end portion of the single hole nozzle according to the present invention, the single hole nozzle can be easily attached to the distal end of a metal burner; therefore, there can be perfectly solved inconveniences associated with a conventional burner that metal impurities and others fly from the distal end portion of the nozzle and then deposit onto a workpiece to contaminate it especially in case of long time heat processing. Since the quartz glass single hole nozzle according to the present invention is detachably attachable, even a burner made of a different material such as metal or ceramic can easily enjoy a material advantage of the quartz glass single hole nozzle, namely high heat resistance and contamination resistance.

BEST MODE FOR CARRYING OUT THE INVENTION

While description will be given of embodiments of the present invention below based on the accompanying drawings, it is needless to say that various changes or modifications other than the embodiments shown in the figures may be made without departing from the technical concept of the present invention.

Figure 1:
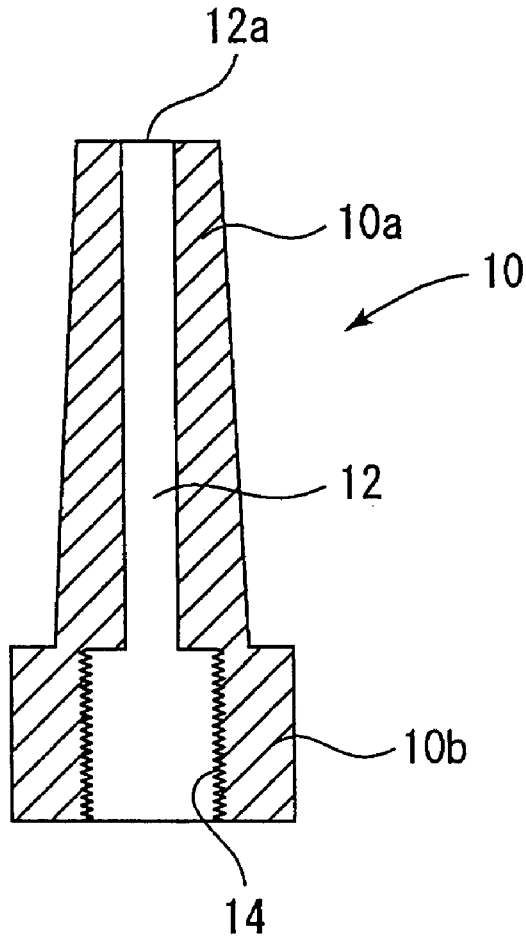
FIG. 1 is a view showing a quartz glass single hole nozzle for feeding according to the present invention, wherein (a) is a descriptive sectional view and (b) a front view.
Figure 1:
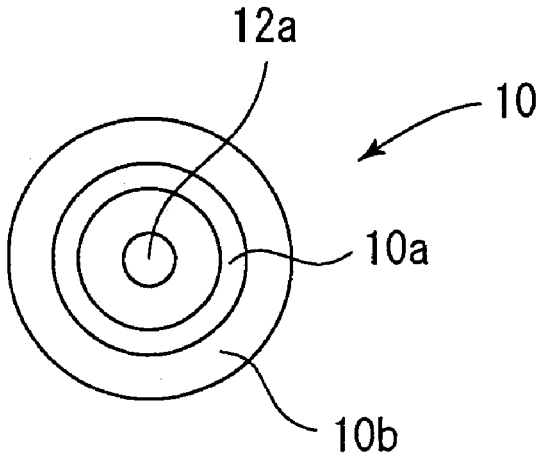
Figure 2:
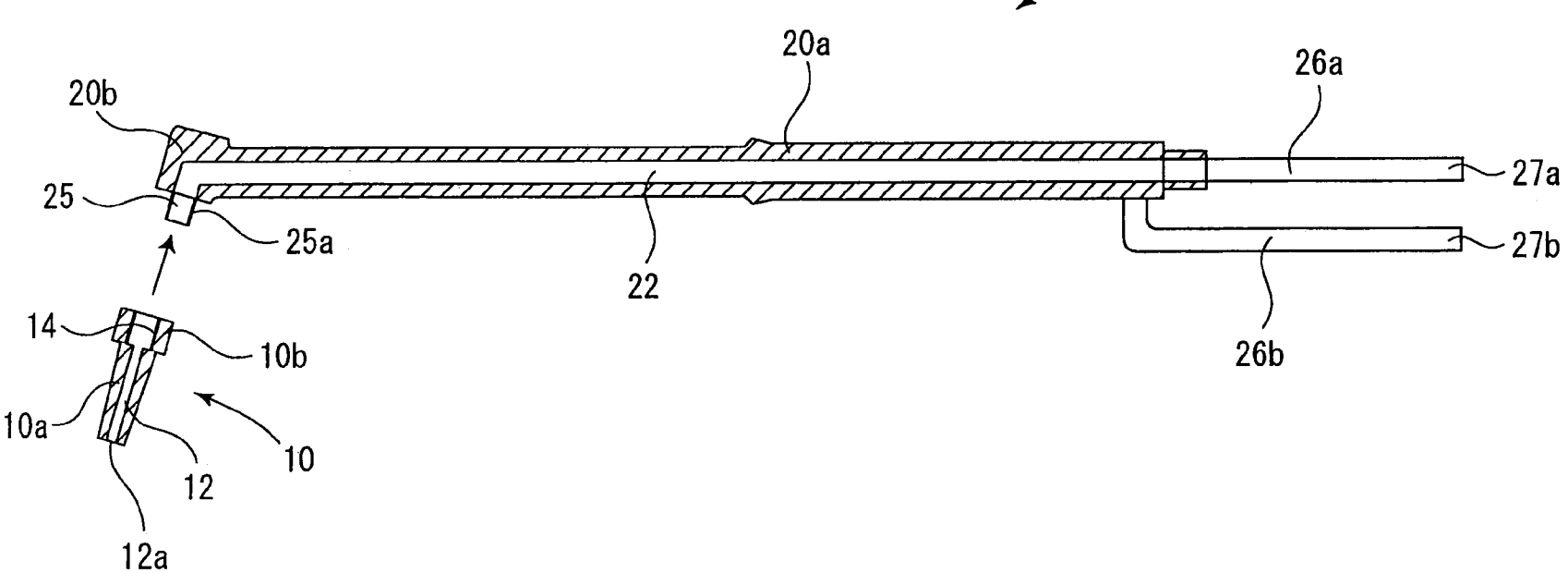
FIG. 2 is a descriptive exploded sectional view showing a quartz glass single hole nozzle for feeding fluid and a quartz glass burner body for heat processing to which the single hole nozzle is attached.
Figure 3:
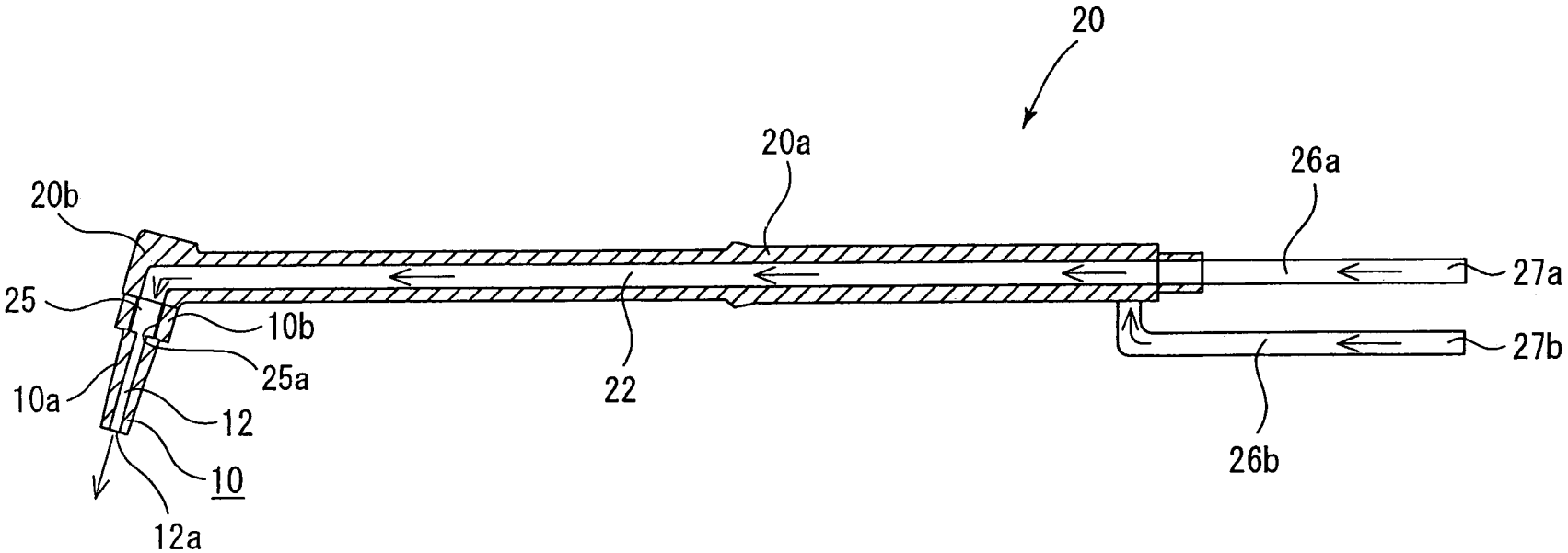
FIG. 3 is a descriptive sectional view showing a state where the quartz glass single hole nozzle for feeding fluid is attached to the quartz glass burner body for heat processing from the state of FIG. 2.
Figure 4:
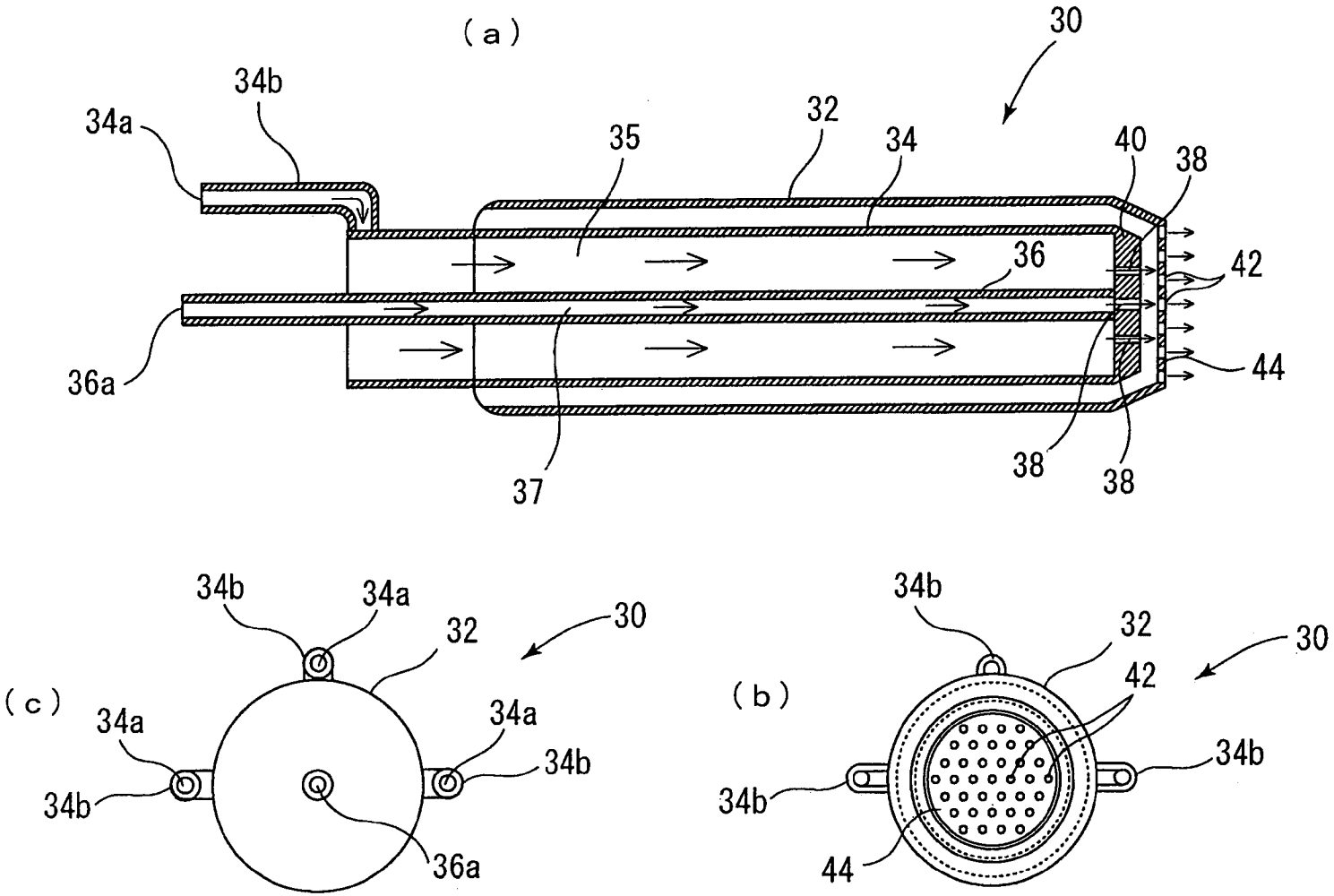
FIG. 4 is a view showing a quartz glass multihole burner for feeding fluid according to the present invention, wherein (a) is a descriptive sectional view, (b) a front view, and(c) a rear.

FIG. 1 is a view showing a quartz glass single hole nozzle for feeding fluid according to the present invention. FIG. 2 is a descriptive exploded sectional view showing a quartz glass single hole nozzle for feeding fluid and a quartz glass burner body for heat processing (a state where a hand burner is completed) to which the single hole nozzle is attached. FIG. 3 is a descriptive sectional view showing a state where the quartz glass single hole nozzle for feeding fluid is attached to the quartz glass burner body for heat processing (a hand burner is constructed) from the state of FIG. 2. By completing the hand burner in this way, the hand burner weighs in the range of from ¼ to ⅕ compared with the conventional stainless steel burner of the same shape. FIG. 4 is a view showing a quartz glass multihole burner for feeding fluid according to the present invention.

In FIG. 1, reference numeral 10 designates a quartz glass single hole nozzle for feeding fluid according to the present invention. The single hole nozzle 10 includes: a nozzle body portion 10*a* shaped so as to be slightly tapered toward the distal end thereof; and a step portion 10*b* having a large diameter provided at the proximal end of the nozzle body portion 10*a*. The step portion 10*b* serves as an attaching portion. Needless to say, a shape of the nozzle body portion 10*a* may be cylindrical or of various shapes other than the embodiment shown in the figure as occasion demands. Reference numeral 12 designates a fluid feed path through which fluid such as gas (gas, liquid, powder or the like) is fed. The fluid feed path 12 is bored in the interior of the nozzle body section 10*a*, and the distal end thereof is a fluid discharge outlet 12*a*. An internal thread portion 14 is formed in the interior of the step portion 10*b*. While the step portion 10*b* shown in the figure has a diameter larger than the nozzle body portion 10*a*, the step portion 10*b* may have the same diameter as the nozzle body portion 10*a* or a smaller diameter than the nozzle body portion 10*a* when occasion demands. Such a size of the step portion 10*b* may be designed according to a feeding mode at need.

Figure 5:
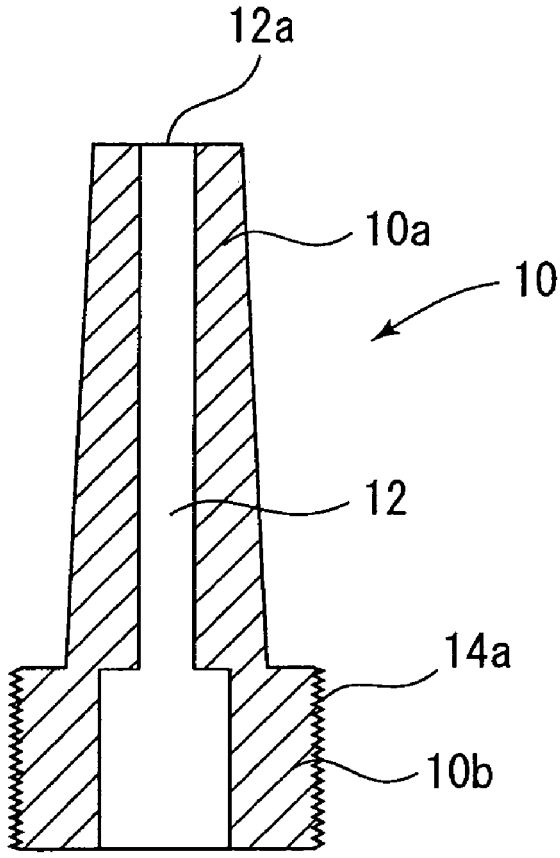
FIG. 5 is a side elevational view in cross-section showing another quartz glass single hole nozzle having an external thread portion.

While, in the figure, there is shown the embodiment where the internal thread portion 14 is formed, as described later the internal thread portion 14 is used to detachably screw the single hole nozzle 10 to the distal end portion of the burner body; therefore, an external thread is formed on the outer surface of the step portion 10*b* to provide an external thread portion 14*a* as shown in FIG. 5.

In FIG. 2, reference numeral 20 designates a quartz glass burner for heat processing according to the present invention. The burner 20 includes: a burner body portion 20*a*; and a burner head portion 20*b* provided at the distal end of the burner body portion 20*a*. Reference numeral 22 designates a fluid feed path for feeding fluid such as gas. The fluid feed path 22 is bored in the interior of the burner 20. Note that by bending the distal end portion of the burner head portion 20*b*, operational convenience is improved.

Reference numeral 25 designates a receiving portion protrusively provided at the distal end of the burner head portion 20*b*. An external thread portion 25*a* is formed on the outer surface of the receiving portion 25. Reference numerals 26*a*, 26*b* are fluid introduction pipes connected to the proximal end of the burner body portion 20*a*. The fluid introduction pipes 26*a*, 26*b* serves so as to introduce fluid such as gas from fluid inlets 27*a*, 27*b* at the proximal ends thereof into the fluid feed path 22. Note that a type of the burner 20 may be a hand burner type and there is imposed no specific limitation thereon.

As shown in FIG. 3, by screwing the internal thread portion 14 of the single hole nozzle 10 to the external thread portion 25*a* of the receiving portion 25, the single hole nozzle 10 is attached to the distal end of the burner head section 20*b*. Since the single hole nozzle 10 is detachably screwed to the receiving portion 25, if the single hole nozzle 10 is broken or the like troubles happen, the single hole nozzle 10 may be easily detached and replaced with a new one. Therefore, poor economy can be avoided that an entire expensive burner is replaced with a new one when a nozzle portion alone is broken, which was a conventional practice.

Note that, as described above, when the internal thread portion 14 of the single hole nozzle 10 is changed to an external thread portion, it is a matter of course that the external thread portion 25*a* of the receiving portion 25 is to be changed to an internal thread portion in correspondence to the change in the single hole nozzle 10.

It is one of the features of the present invention that the respective fluid feed paths 12, 22 of the single hole nozzle 10 and the burner 20 according to the present invention are bored. Especially, a high purity synthetic quartz glass rod is used as a quartz glass material, a diameter to be machined is directly set with precision, and the fluid feed paths 12, 22 are concentrically bored by drilling, thereby to enable correct control of a flow rate of fluid flowing through the fluid feed paths 12, 22.

Furthermore, in FIGS. 2 and 3, while there are shown the embodiments where the quartz glass single hole nozzle 10 according to the present invention is attached to the distal end of the quartz glass burner 20, a burner made of a material other than the quartz glass such as a metal burner may be replaced therewith. That is, there may be employed such a construction that the quartz glass single hole nozzle 10 according to the present invention is detachably attached to a distal end receiving portion of a metal burner (not shown) having a shape similar to the quartz glass burner 20 shown in FIGS. 2 and 3. By use of a quartz glass single hole nozzle of the present invention, there can be perfectly solved inconveniences that metal impurities and others fly from the distal end portion of the nozzle and then deposit onto a workpiece to contaminate it, especially in case of long time heat processing with a conventional metal burner. That is, since a quartz glass single hole nozzle 10 according to the present invention is detachably attachable, even a burner made of a material other than quartz glass such as metal can enjoy a material advantage of the quartz glass single hole nozzle, that is heat resistance and contamination resistance.

In the above description, there is shown the embodiment where the quartz single hole nozzle 10 is fabricated separately and detachably attached to the burner 20. There may be also employed such a construction that a nozzle portion having a structure similar to the quartz glass single hole nozzle 10 described above is integrally formed at the distal end portion of the quartz glass burner for heat processing 20 by precisely boring with drilling. In this case as well, there is enjoyed an advantage that a flow rate of fluid flowing through the flow path can be precisely controlled in advance.

Next, description will be given of a quartz glass multihole burner head for feeding fluid according to the present invention based on FIG. 4. In FIG. 4, reference numeral 30 designates a quartz glass multihole burner head for feeding fluid according to the present invention. The burner head 30 includes: an outer cylinder 32; an inner cylinder 34 provided in the interior of the outer cylinder 32 at a prescribed space therebetween; and a central cylinder 36 provided in the interior of the inner cylinder 34 at a prescribed space therebetween. A fluid introduction tube 34*b* at the proximal end of which an inlet 34*a* for fluid such as gas or the like is provided is attached to the proximal end of the inner cylinder, and fluid can be introduced from the fluid inlet 34*a* into the fluid feed path 35 in the interior of the inner cylinder 34. The proximal end portion of the central cylinder 36 extends outwardly and the proximal end becomes a fluid inlet 36*a*. With the construction, fluid can be introduced from the fluid inlet 36*a* into a fluid feed path 37 in the interior of the central cylinder 36.

A nozzle portion 40 having many throughholes 38 bored therein is integrally provided at the distal ends of the inner cylinder 34 and the central cylinder 36. Furthermore, a tip portion 44 having many fluid path outlets 42 bored therein is provided at the distal end of the outer cylinder 32 located at a prescribed space in front of the distal end of the nozzle portion 40.

A feature of the quartz glass multihole burner head for feeding fluid 30 according to the present invention resides in that the fluid feed paths 35,37, the throughholes 38 and the fluid path outlets 42 are bored in parallel to each other; when discharging fluid such gas, a flow of the fluid is not converged and the fluid flows out in a state of non-convergence. While such a burner of so-called straight type is required in flame processing or the like, the burner of this type has been hardly fabricated because it is difficult to secure an exact straight advance of drilling for boring according to the conventional technology. The inventors have developed a precision drilling tool and made precision drilling possible with the drilling tool; fabrication of the above multihole burner head 30 has been made possible. By detachably attaching the multihole burner head 30 to the distal end receiving portion of the quartz glass burner 20, a metal burner or a ceramic burner, such an assembled burner can be used as a heat processing burner equipped with the multihole burner head 30.

EXAMPLES

More concrete description will be given of the present invention showing examples. First of all, there are shown Example 1 in which a single hole nozzle according to the present invention was used and Comparative Example 1 in which a conventional metal (brass) nozzle was used.

Example 1 and Comparative Example 1

With a workpiece of a fused natural quartz rod of 15 mm in diameter, there were used a single hole nozzle made of synthetic quartz glass according to the present invention and a conventional brass single hole nozzle under the conditions shown in Table 1.

TABLE 1

| | | Fluid flow rate | Distance between nozzle distal end and workplace | Results |
|---|---|---|---|---|
| Example 1 | Synthetic quartz glass single hole nozzle (3 mm ϕ) | Oxygen 20 L/min Hydrogen 50 L/min | ≈20 mm | No deposition was formed on workpiece surface |
| Comparative Example 1 | Brass single hole nozzle (3 mm ϕ) | Oxygen 20 L/min Hydrogen 50 L/min | ≈20 mm | After about 10 min (spotty) metal deposition was formed on workpiece surface |

Example 2

A rectangular quartz glass cap was attached to the distal end of a single hole nozzle made of a synthetic quartz glass according to the present invention to generate a flame (torch) of a combustion reaction between oxygen and hydrogen from a single slit and the single slit was located at prescribed position (X, Y, Z) to take data of an ignition test. A flow rate (F) of oxygen-hydrogen mixed gas, a sectional size of the single slit (S), a distance from the slit to a thermocouple for measurement (D) was varied, and by measuring a temperature (T° C.), temperature distribution and flame stability were investigated. The investigation showed good results that variations of temperature distribution in a flame of a nozzle according to the present invention were small. Note that a ratio between flow rates of oxygen and hydrogen was set to 2:5.

TABLE 2

| | Single slit (S) | | D | | |
|---|---|---|---|---|---|
| F (cc) | 3 mm × 20 mm | 1 mm × 11 mm | 1 mm | 1.4 mm | 1.8 mm |
| [1] (X, Y, Z) = (0 mm, 2 mm and 0 mm) | | | | | |
| 200 | 996° C. | 971° C. | 962° C. | 939° C. | 914° C. |
| 250 | 1010° C. | 990° C. | 996° C. | 975° C. | 964° C. |
| 300 | 1029° C. | 1004° C. | 1022° C. | 1005° C. | 989° C. |
| [2] (X, Y, Z) = (0 mm, 3 mm and 0 mm) | | | | | |
| 200 | 936° C. | 941° C. | 919° C. | 912° C. | 890° C. |
| 250 | 984° C. | 995° C. | 980° C. | 971° C. | 847° C. |
| 300 | 1024° C. | 1038° C. | 1018° C. | 1017° C. | 1004° C. |
| [3] (X, Y, Z) = (0 mm, 4 mm and 0 mm) | | | | | |
| 200 | 863° C. | 879° C. | 810° C. | 811° C. | 783° C. |
| 250 | 904° C. | 936° C. | 880° C. | 870° C. | 878° C. |
| 300 | 960° C. | 1009° C. | 945° C. | 933° C. | 947° C. |

Capability of Exploitation in Industry:

As described above, when a quartz glass single hole nozzle for feeding fluid according to the present invention is applied to a quartz glass heat processing burner, flow rate control can be realized with high precision, and even when the distal end portion (nozzle) is broken by contact with a workpiece or the like, it is enough to only replace the broken nozzle with a new one without a necessity for replacing the entire expensive quartz glass burner, and when the quartz glass single hole nozzle for feeding fluid is applied to a metal burner, the metal burner can enjoy a material advantage of the quartz glass nozzle for feeding fluid, that is high heat resistance and contamination resistance. With the quartz glass multihole burner head for feeding fluid according to the present invention, fluid can flow out in a state of non-convergence; therefore, a burner used for heat processing in which combustion gas of non-convergence is fed is preferably used for flame processing or the like.

In addition, as fluid to be fed in the quartz glass single hole nozzle according to the present invention, any gas for a combustion reaction may be employed as far as uses for heat processing, and there are exemplified various kinds of liquid, mixed gases, powder, vapor materials and others in preparation of new compounds and mixtures. If the entire burner body is made of quartz glass, highly corrosive liquid or gas can be fed at ease. Especially, the quartz glass single hole nozzle according to the present invention may be used for a super high purity synthetic reaction and other chemical reactions without contamination of unnecessary impurities into a product or a substance to be treated. If the entire body of the burner is made of quartz glass, it weighs about ⅕ of a stainless steel burner and due to the light weight thereof, a precise operability is ensured.

The invention claimed is:

1. A quartz glass multihole burner head for feeding fluid fabricated by boring a quartz glass material, comprising: an outer cylinder; an inner cylinder provided in the interior of the outer cylinder at a prescribed space therebetween and having a fluid feed path in the interior thereof; a central cylinder provided in the interior of the inner cylinder at a prescribed space therebetween and having a fluid feed path in the interior thereof; a nozzle portion having many throughholes bored therein and integrally provided at the distal ends of the inner cylinder and the central cylinder; and a tip portion having many fluid path outlets bored therein and provided at the distal end of the outer cylinder located at a prescribed space in front of the distal end of the nozzle portion, wherein the fluid feed paths, the through holes and the fluid path outlets are parallel to each other, when discharging fluid a flow of the fluid is not converged, and the fluid flows out in a state of non-convergence.

2. A burner for heat processing comprising: a burner body portion; a burner head portion provided at the distal end of the burner body portion, wherein the multihole burner head according to claim 1 is used as the burner head portion.

* * * * *